US008478314B2

(12) United States Patent
Chung et al.

(10) Patent No.: US 8,478,314 B2
(45) Date of Patent: Jul. 2, 2013

(54) COMMUNICATION METHOD FOR A MOBILE SENSOR NODE IN A WIRELESS SENSOR NETWORK

(75) Inventors: Tae-Yun Chung, Gangneung-si (KR); Han-Su Chung, Gangneung-si (KR); Pan-Jong Park, Gangneung-si (KR)

(73) Assignee: Gangneung-Wonju National University Industry Academy Cooperation Group (KR)

( * ) Notice: Subject to any disclaimer, the term of this patent is extended or adjusted under 35 U.S.C. 154(b) by 572 days.

(21) Appl. No.: 12/829,684

(22) Filed: Jul. 2, 2010

(65) Prior Publication Data

US 2011/0001612 A1 Jan. 6, 2011

(30) Foreign Application Priority Data

Jul. 6, 2009 (KR) ..... 10-2009-0060993

(51) Int. Cl.
*H04W 4/00* (2009.01)

(52) U.S. Cl.
USPC ..... 455/466; 370/328; 340/286.02

(58) Field of Classification Search
USPC ..... 340/506, 539.13, 541, 268.02; 455/466, 455/550.1; 370/328, 408
See application file for complete search history.

(56) References Cited

U.S. PATENT DOCUMENTS

| | | | | |
|---|---|---|---|---|
| 6,636,914 | B1 * | 10/2003 | Johas Teener | 710/240 |
| 7,853,785 | B1 * | 12/2010 | Thurman et al. | 713/158 |
| 8,179,239 | B2 * | 5/2012 | Chen et al. | 340/435 |
| 2003/0227931 | A1 * | 12/2003 | Chen et al. | 370/408 |
| 2005/0060202 | A1 * | 3/2005 | Taylor et al. | 705/2 |
| 2005/0201278 | A1 * | 9/2005 | Banerjee et al. | 370/229 |
| 2006/0171352 | A1 * | 8/2006 | Seo et al. | 370/328 |
| 2007/0070909 | A1 * | 3/2007 | Reeve | 370/238 |
| 2007/0153720 | A1 * | 7/2007 | Baglin et al. | 370/328 |
| 2008/0095100 | A1 * | 4/2008 | Cleveland et al. | 370/328 |
| 2008/0170538 | A1 * | 7/2008 | Duggi et al. | 370/328 |
| 2009/0215477 | A1 * | 8/2009 | Lee et al. | 455/466 |
| 2010/0097988 | A1 * | 4/2010 | Chung et al. | 370/328 |
| 2010/0177684 | A1 * | 7/2010 | Kore et al. | 370/328 |
| 2010/0207786 | A1 * | 8/2010 | Chen et al. | 340/903 |
| 2011/0001612 | A1 * | 1/2011 | Chung et al. | 340/286.02 |
| 2011/0238864 | A1 * | 9/2011 | Purzynski | 709/242 |

FOREIGN PATENT DOCUMENTS

KR 10-2008-0070966 8/2008

* cited by examiner

*Primary Examiner* — Jennifer Mehmood
*Assistant Examiner* — Rufus Point
(74) *Attorney, Agent, or Firm* — Cantor Colburn LLP

(57) ABSTRACT

A communication method for a mobile sensor node in a wireless sensor network includes: in a state that the mobile sensor node performs synchronization by a message reception interrupt from a parent sensor node and determines an uplink active duration and a downlink active duration, transmitting a message to the parent sensor node in the transmitting duration of the uplink active duration, receiving and processing messages from the parent sensor node and sensor nodes linearly connected around the parent sensor node in the receiving duration of the uplink active duration, and resetting a new parent sensor node using the received signal strength indications RSSIs of the received messages; and transmitting a message to the parent sensor node in the transmitting duration of the downlink active duration, checking whether or not a message is received from the parent sensor node in the receiving duration of the downlink active duration, if the message is not received from the parent sensor node, determining that time synchronization fails and resetting a new parent sensor node, and if the message is received from the parent sensor node, performing time synchronization according to a message reception interrupt from the parent sensor node.

5 Claims, 6 Drawing Sheets

COMMUNICATION METHOD FOR A MOBILE SENSOR NODE IN A WIRELESS SENSOR NETWORK

CROSS-REFERENCE TO RELATED PATENT APPLICATION

This application claims the benefit of Korean Patent Application No. 10-2009-0060993, filed on Jul. 6, 2009, in the Korean Intellectual Property Office, the disclosure of which is incorporated herein in its entirety by reference.

BACKGROUND OF THE INVENTION

1. Field of the Present Invention

The present invention relates to a wireless sensor network and, more particularly, to a communication method for a mobile sensor node in a wireless sensor network.

2. Description of the Related Art

A wireless sensor network is a key enabling technology for implementing a ubiquitous computing technology. In the wireless sensor network, a plurality of nodes may be connected to each other to operate in a wireless manner.

In the sensor network, since each node operates with a battery having a limited capacity, measured data need to be transmitted by using minimum energy. In addition, in order to adapt the sensor network to a real-time application system, transmission delay in a large-scale sensor network needs to be minimized. Therefore, for a sensor network requiring real-time monitoring, a protocol capable of minimizing energy consumption of the battery and decreasing the network transmission delay has been requested.

According to the request, the inventor filed Korean Patent Application No. 10-2007-0008935, titled "Wireless Sensor Network Having Linear Structure Performing Bidirectional Data Communication and Method" in Korean Intellectual Patent Office.

The patent application discloses a technology of performing bidirectional communication between a sync node and a terminal node in a single period of an active duration in a wireless sensor network which is constructed with a plurality of nodes and in which each node is connected to one upper node and one lower node so that the sync node through the terminal node are linearly connected, wherein each node includes an active duration in which data are transmitted and received with respect to the upper node and the lower node, wherein active duration includes a downlink active duration in which data/commands are transmitted from the sync node to the terminal node and an uplink active duration in which data/commands are transmitted from the terminal node to the sync node.

The aforementioned wireless sensor network has been widely used for watching a forest fire on a mountain or a sign of bridge collapse, detecting destruction of cultural assets. In order to improve the utility of the wireless sensor network, additional technology has been required to develop. Particularly, a technology of communication between the mobile sensor node and the wireless sensor network for implementing a real-time test, a missing child search service, or the like has been required to develop.

SUMMARY OF THE INVENTION

The present invention provides a communication method for a mobile sensor node in a wireless sensor network, wherein the mobile sensor node selects one of the sensor nodes in the wireless sensor network as a parent node and communicates with the selected parent node.

The present invention also provides a communication method for a mobile sensor node in a wireless sensor network, wherein in a case where a plurality of the mobile sensor nodes simultaneously selects one of sensor nodes in the wireless sensor network as a parent node, the parent node is determined through competition.

According to an aspect of the present invention, there is provided a communication method for a mobile sensor node in a wireless sensor network which is constructed by linearly connecting a plurality of sensor nodes, including: in a state that the mobile sensor node performs synchronization with reference to a message reception interrupt from a parent sensor node and determines transmitting and receiving durations of an uplink active duration and transmitting and receiving durations of a downlink active duration, transmitting a message to the parent sensor node in the transmitting duration of the uplink active duration, receiving and processing messages from the parent sensor node and sensor nodes linearly connected around the parent sensor node in the receiving duration of the uplink active duration, and resetting the parent sensor node with reference to receiving signal intensities of the received messages; and transmitting a message to the parent sensor node in the transmitting duration of the downlink active duration, checking whether or not a message is received from the parent sensor node in the receiving duration of the downlink active duration, if the message is not received from the parent sensor node, determining that time synchronization fails and resetting the parent sensor node, and if the message is received from the parent sensor node, performing synchronization according to a message reception interrupt from the parent sensor node.

According to the present invention, the mobile sensor node can select one of the sensor nodes in the wireless sensor network as a parent node, so that the mobile sensor node can perform communication through the selected parent node. Therefore, the mobile sensor node is adapted to the wireless sensor network, so that the wireless sensor network can be used for a real-time test, a missing child search service, or the like.

DESCRIPTION OF THE PREFERRED EMBODIMENTS

Figure 1:
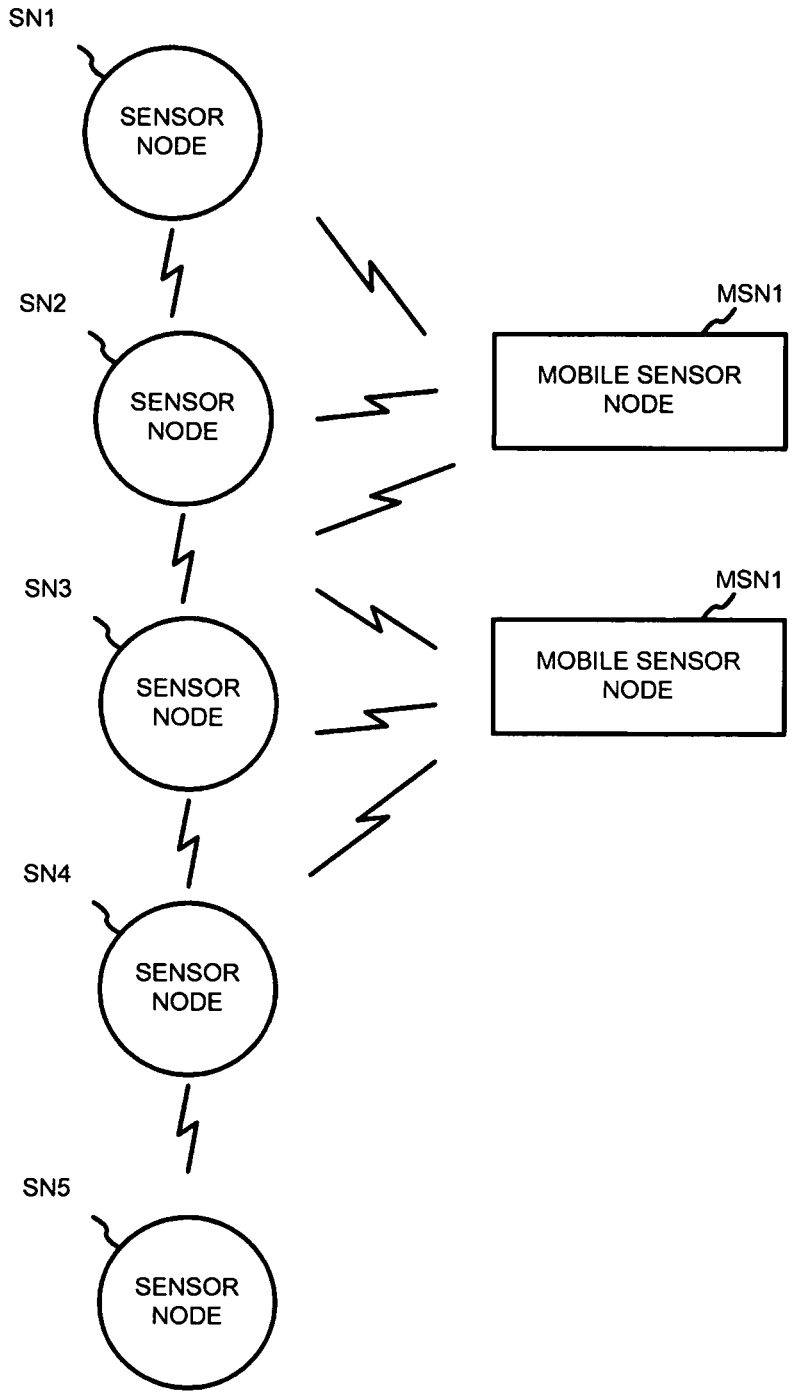
FIG. 1 is a view illustrating a configuration of a wireless sensor network according to an embodiment of the present invention.

A configuration of a wireless sensor network according to an embodiment of the present invention is described with reference to FIG. 1.

The wireless sensor network includes a plurality of sensor nodes SN1 to SN5. The plurality of the sensor nodes SN1 to SN5 constitute a linear network. Each sensor node connects with an upper level sensor node and a lower level sensor node. Each sensor node has an active duration where data are transmitted and received, and an inactive duration. The active duration includes a downlink active duration, an uplink active duration, and a intermission duration. In addition, each of the downlink active duration and the uplink active duration includes a transmitting duration, a receiving duration, and an acknowledge duration. Each of the transmitting duration and the receiving duration includes actual transmitting and receiving durations and transmitting and receiving data processing durations. The plurality of sensor nodes SN1 to SN5 transmit uplink data through the uplink active duration via the linear network to an upper level and transmit downlink data through the downlink active duration via the linear network to a lower level. Particularly, according to the preferred embodiment of the present invention, the plurality of sensor nodes SN1 to SN5 sustain a receiving mode in the transmitting data processing duration to receive data from the mobile sensor node.

In the wireless sensor network, one or more mobile sensor nodes MSN1 and MSN2 are positioned. The positions of the mobile sensor nodes MSN1 and MSN2 vary with a change in a user's location.

Every time when communication is needed, each of the mobile sensor nodes MSN1 and MSN2 sets any one of the plurality of sensor nodes SN1 to SN5 as a parent sensor node at a position thereof and performs time synchronization to transmit the uplink data through the selected parent sensor node to the linear network constructed with the plurality of sensor nodes SN1 to SN5 or to receive the downlink data from the linear network.

In addition, after setting the parent sensor node, by taking into consideration the case where a different mobile sensor node setting the same sensor node as a parent node exists, each of the mobile sensor nodes MSN1 and MSN2 performs priority competition with the different mobile sensor node to perform communication or to stand by until the next period and perform communication according to the competition result. In the mobile sensor nodes MSN1 and MSN2, at the initial period, the priority is set at random. If the number of competition failure increases, the priority is set to be heightened, so that the QoS may be maintained.

Figure 2A:
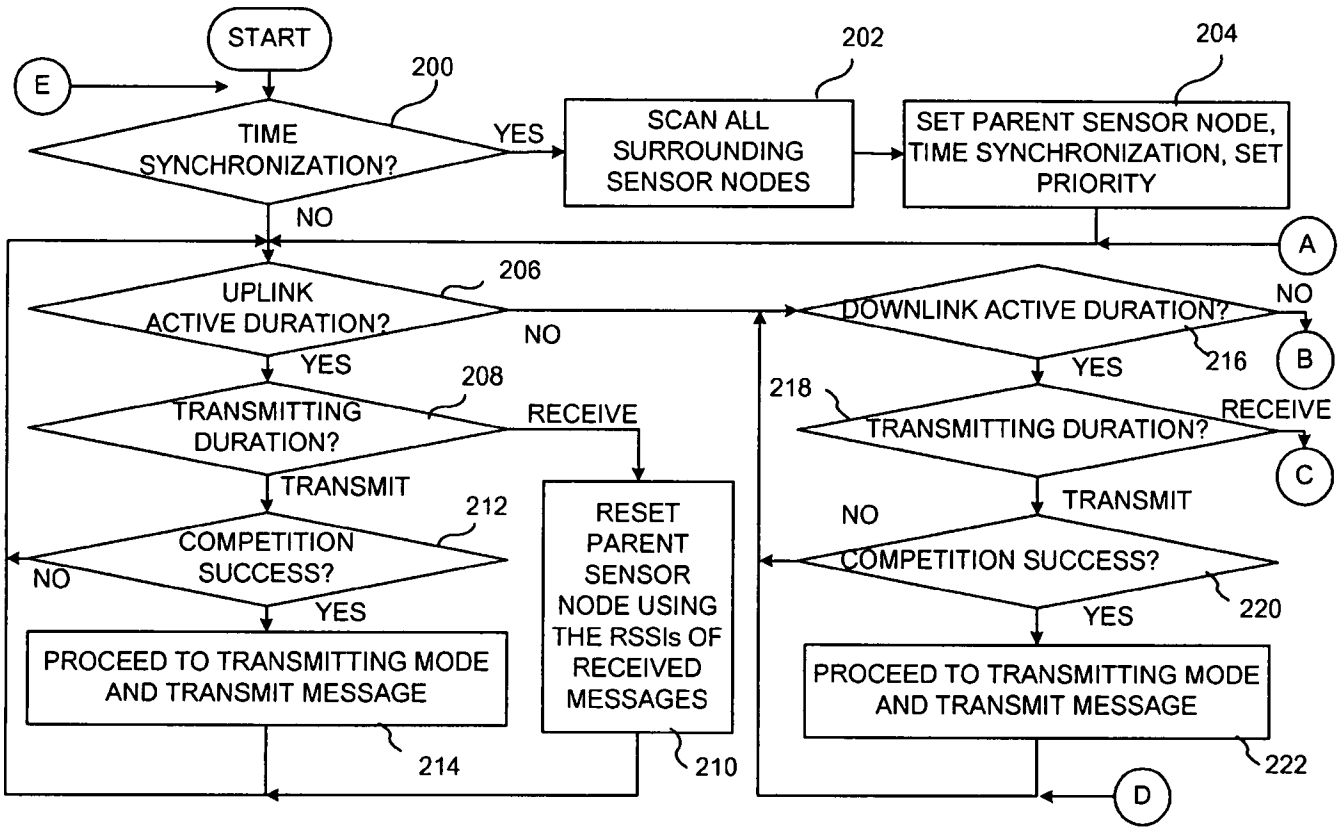
FIGS. 2A and 2B are flowcharts of a communication method for a mobile sensor node according to an embodiment of the present invention.
Figure 2B:
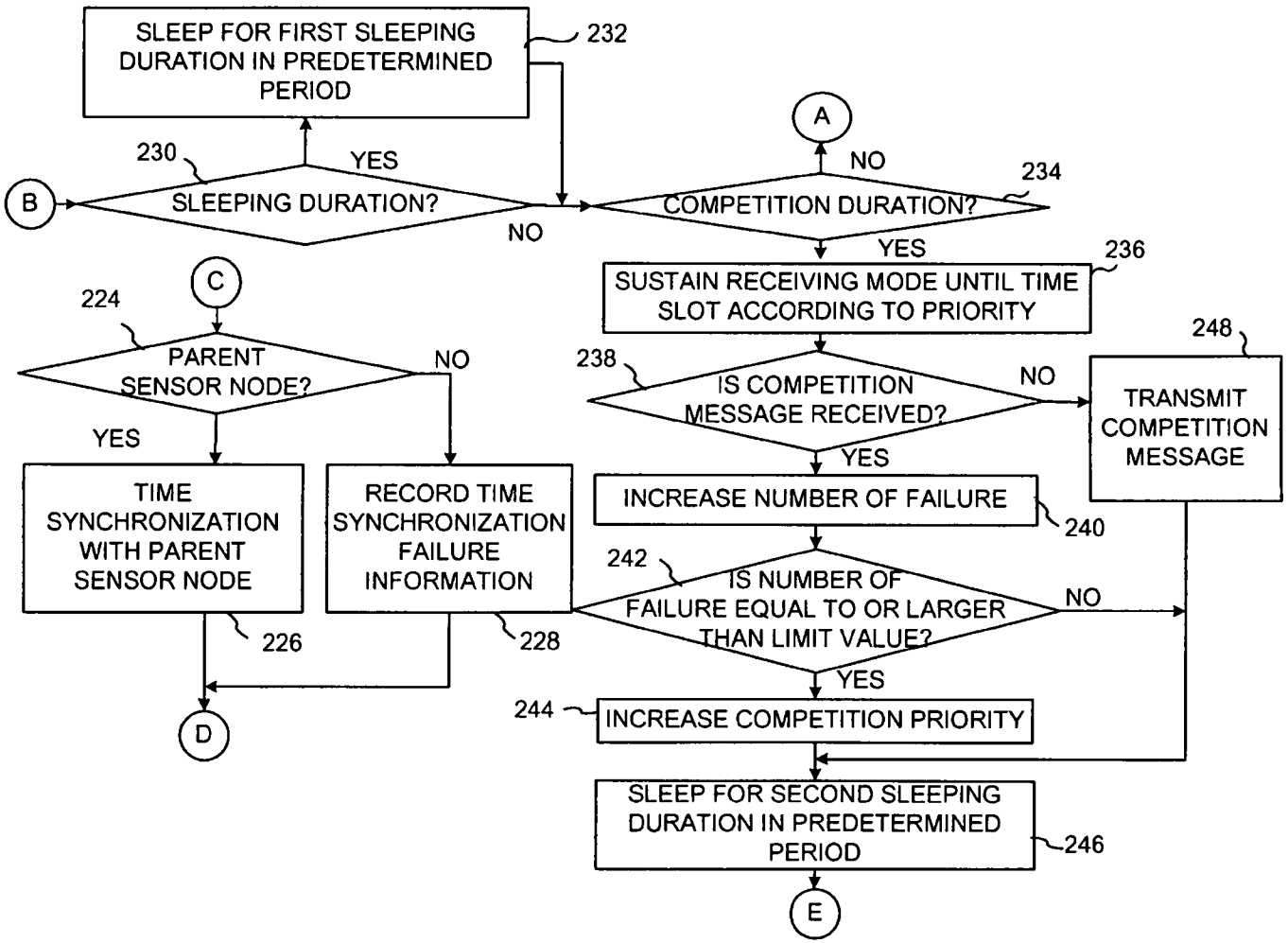
Figure 3:
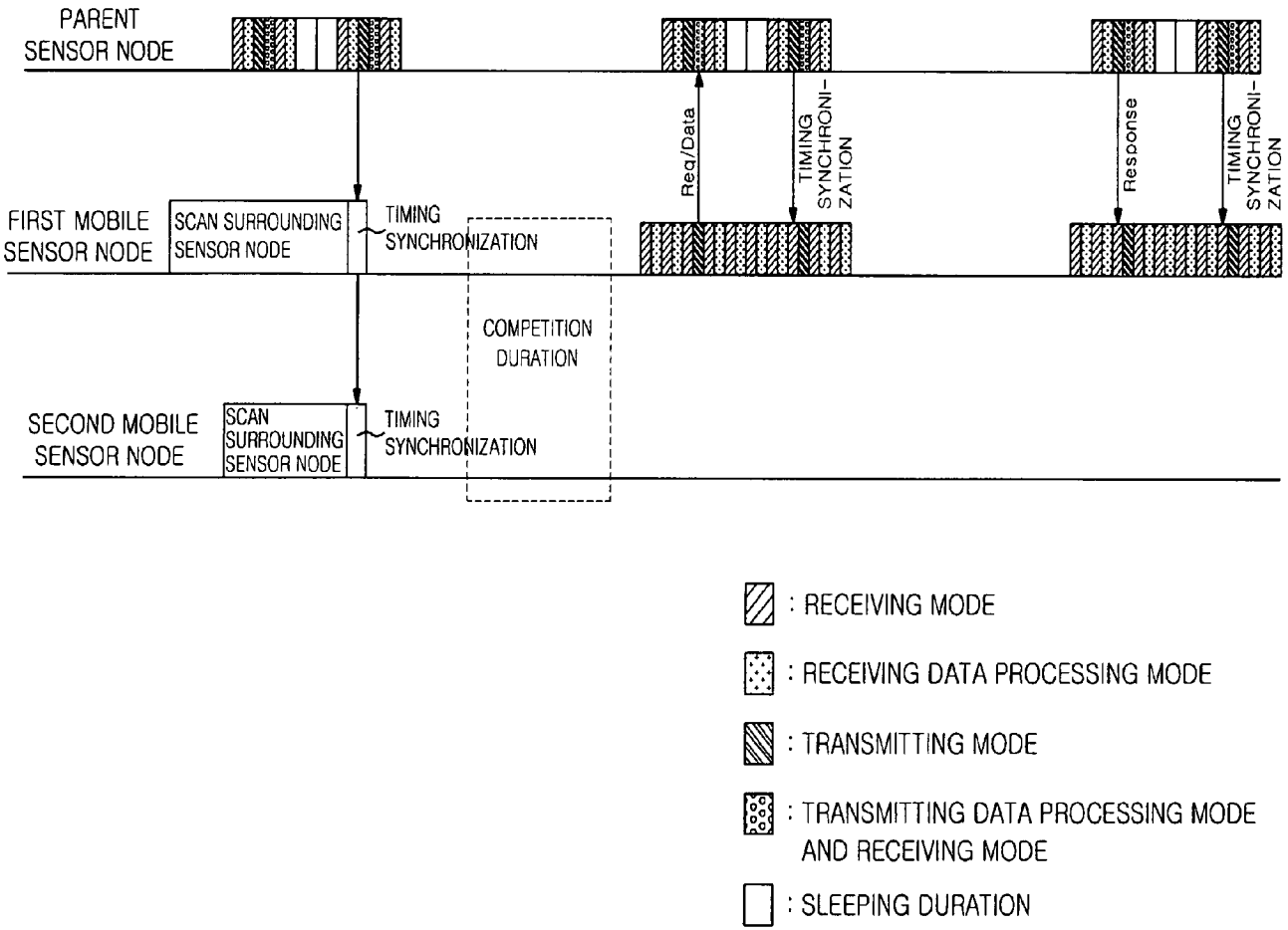
FIG. 3 is a timing diagram for operations between sensor nodes according to an embodiment of the present invention.

The communication method for the mobile sensor node is described with reference to flowcharts of FIGS. 2A and 2B.

If one of the mobile sensor nodes needs to communicate with the wireless sensor network due to a user's request or an arrival of a setting period, the mobile sensor node checks based on time synchronization information whether or not time synchronization is completed (Step 200). If the time synchronization is not completed, the mobile sensor node performs scanning all the surrounding sensor nodes for a predetermined time period, sets a new parent sensor node with reference to the received signal strength indications RSSIs of messages received by the scanning, performs the time synchronization, and records information indicating that the time synchronization is completed in time synchronization information (Steps 202 to 204). Herein, the time synchronization includes a series of steps of synchronizing time points with reference to an interrupt according to message transmission of the parent sensor node and an interrupt according to message reception of the mobile sensor node which occur simultaneously, setting an uplink active duration, a downlink active duration, a first sleeping duration, a competition duration, and a second sleeping duration, and determining the priority. Each of the uplink active duration and the downlink active duration includes the receiving duration and the transmitting duration. The receiving duration is constructed with a plurality of receiving mode sustaining periods so that the message can be received from a predetermined number or more of sensor nodes. This is because, at the time of movement of the mobile sensor node, a sensor node surrounding the existing parent sensor node is likely to be set as a new parent node. Therefore, in the case where the mobile sensor node cannot communicate with the existing parent sensor node due to the movement of the mobile sensor node, the parent sensor node can be rapidly reset. Particularly, the mobile sensor node sets the receiving duration thereof to be coincident with the transmitting duration of the parent sensor node and sets the transmitting duration thereof to be coincident with the transmitting data processing duration and the receiving duration of the parent sensor node.

Figure 4:
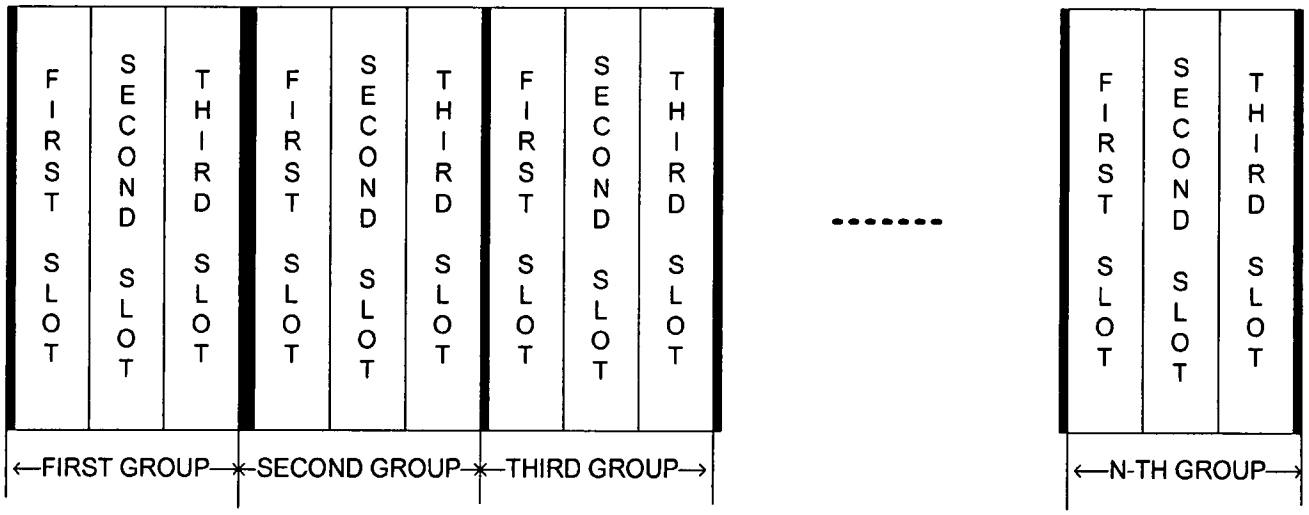
FIG. 4 is a view illustrating an example of a priority determination message of a mobile sensor node according to an embodiment of the present invention.

In addition, as illustrated in FIG. 4, the competition duration of the mobile sensor node is divided into a plurality of time slots, and any one of the divided time slots is set at random, so that the priority of the mobile sensor node is determined. Particularly, the time slots may be grouped into some small groups. In this case, if the to-be-transmitted data are data requesting for urgent transmission, the mobile sensor node may select the time slot of the time slot group located at an early portion of the competition duration. In addition, when the number of the competition failure is equal to or larger than a predetermined limit value, the mobile sensor node may adjust the priority by advancing the locations of the time slots in units of group. This configuration is provided so as to enable the priority transmission of the urgent data and to ensure the QoS.

Next, if the uplink active duration arrives (Step 206), the mobile sensor node checks whether or not the transmitting or receiving duration of the uplink active duration arrives (Step 208). In the receiving duration of the uplink active duration, the mobile sensor node resets a new parent sensor node with reference to the received signal strength indications RSSIs of the received messages (Step 210). On the contrary, in the transmitting duration of the uplink active duration, if the mobile sensor node succeeds in the competition at a preceding timing, the mobile sensor node proceeds to the transmitting mode to transmit a message (Step 214).

If the downlink active duration arrives (Step 216), the mobile sensor node checks whether or not the transmitting or receiving duration of the downlink active duration arrives (Step 218). In the transmitting duration of the downlink active duration, if the mobile sensor node succeeds in the competition at a preceding timing, the mobile sensor node proceeds to the transmitting mode to transmit a message (Steps 220 and 222). On the contrary, in the receiving duration of the downlink active duration, the mobile sensor node checks whether or not a message is received from the parent sensor node (Step 224). If the message is received from the parent sensor node, the mobile sensor node synchronizes time points with reference to an interrupt according to message transmission of the parent sensor node and an interrupt according to message reception of the mobile sensor node, which occur simultaneously (Step 226). On the contrary, if data are not received from the parent sensor node, the mobile sensor node determines that the time synchronization fails and records information indicating time synchronization failure in the time synchronization information (Step 228).

In addition, the mobile sensor node checks whether or not the first sleeping duration arrives (Step 230). If the first sleeping duration arrives, the mobile sensor node performs sleeping for the predetermined first sleeping duration (Step 232).

In addition, the mobile sensor node checks whether or not the competition duration arrives (Step 234). If the competition duration arrives, the mobile sensor node checks whether or not a competition message is received from a different mobile sensor node while sustaining the receiving mode until a time slot with the priority arrives (Step 236, Step 238).

If the competition message is not received until the time slot with the priority arrives, the mobile sensor node determines that the mobile sensor node succeeds in the competition, records competition success information, and transmits to the different mobile sensor node the competition message. After that, the mobile sensor node performs sleeping for a predetermined second sleeping duration and returns to Step 200 (Steps 248 and 246).

Unlike the aforementioned case, if the competition message is received before the time slot arrives (Step 238), the mobile sensor node increase the number of competition failure (Step 240). If the number of competition failure is equal to or larger than a predetermined limit value (Step 242), the mobile sensor node heightens the priority. The mobile sensor node performs sleeping for a predetermined second sleeping duration and, after that, returns to Step 200 (Steps 244 and 246).

Figure 5:
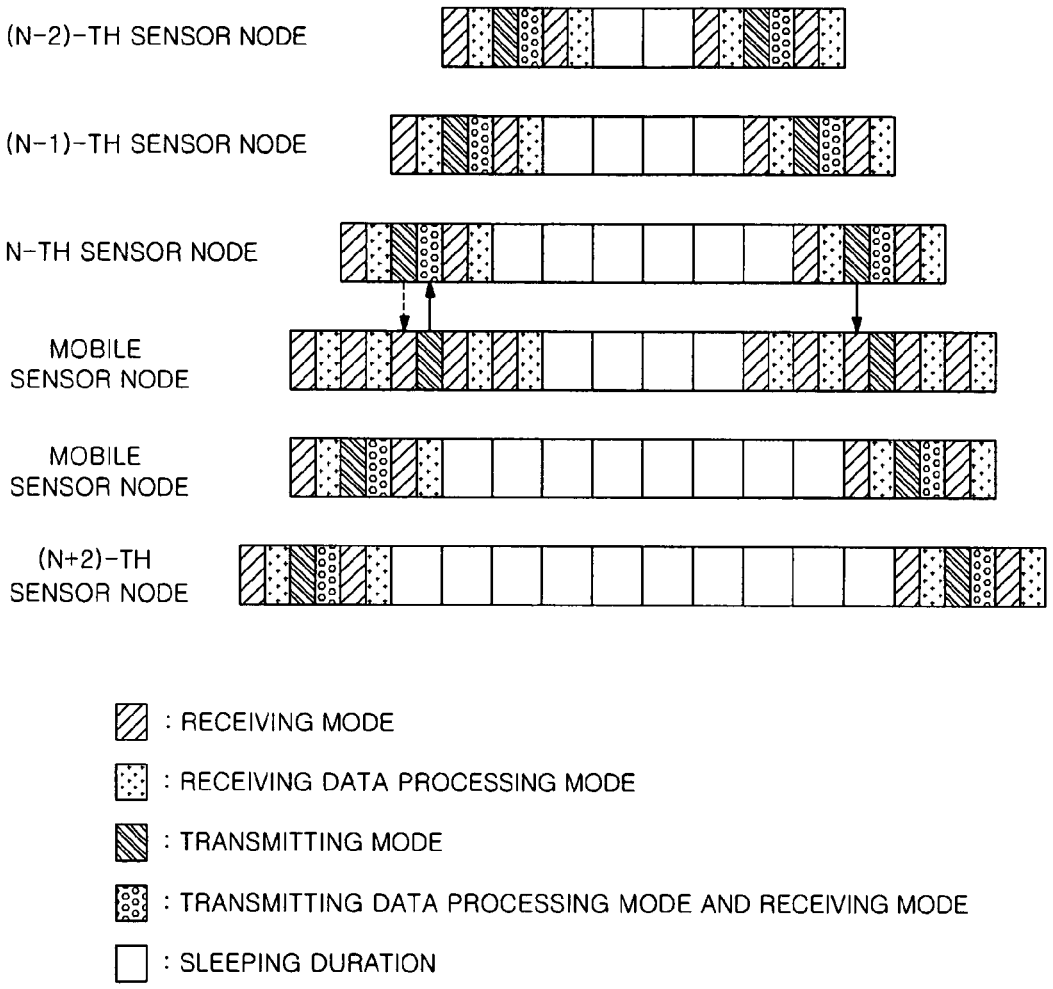
FIG. 5 is a timing diagram for operations between sensor nodes according to an embodiment of the present invention.

The operations of the mobile sensor node according to the preferred embodiment of the present invention are described with reference to FIG. 5.

The mobile sensor node scans surrounding sensor nodes and sets a parent sensor node. The mobile sensor node sustains a predetermined number of sensor nodes with reference to the parent sensor node to be in a message reception state. Therefore, in a state that a message is transmitted or received through the parent sensor node, if the communication with the parent sensor node abruptly fails, the time synchronization may not be achieved, or if there is a sensor node which transmits a message having a received signal strength indication RSSI higher than that of the existing parent sensor node, the sensor node is set as a new parent sensor node. Accordingly, even when the mobile sensor node freely moves, the mobile sensor node can smoothly communicate with the wireless sensor network.

What is claimed is:

1. A communication method for a mobile sensor node in a wireless sensor network which is constructed by linearly connecting a plurality of sensor nodes, comprising:

in a state that the mobile sensor node performs synchronization with reference to a message reception interrupt from a parent sensor node and determines transmitting and receiving durations of an uplink active duration and transmitting and receiving durations of a downlink active duration, transmitting a message to the parent sensor node in the transmitting duration of the uplink active duration, receiving and processing messages from the parent sensor node and sensor nodes linearly connected around the parent sensor node in the receiving duration of the uplink active duration, and resetting a new parent sensor node with reference to a received signal strength indication RSSI of the received messages; and transmitting a message to the parent sensor node in the transmitting duration of the downlink active duration, checking whether or not a message is received from the parent sensor node in the receiving duration of the downlink active duration, if the message is not received from the parent sensor node, determining that time synchronization fails and resetting a new parent sensor node, and if the message is received from the parent sensor node, performing synchronization according to a message reception interrupt from the parent sensor node.

2. The communication method for a mobile sensor node according to claim 1, further comprising:

at the time of initialization of the mobile sensor node and at the time of resetting a new parent sensor node, receiving messages transmitted by the plurality of sensor nodes while sustaining a receiving mode for a predetermined duration; setting any one of the sensor nodes, which transmit the messages, as a parent sensor node of the mobile sensor node; and performing time synchronization with reference to the message reception interrupt from the parent sensor node and time synchronization for determining the transmitting and receiving durations of the uplink active duration and the transmitting and receiving durations of the downlink active duration.

3. The communication method for a mobile sensor node according to claim 2, further comprising:

at the time of the time synchronization, setting a portion of the inactive duration as a competition duration;

dividing the competition duration into a plurality of time slots;

selecting one of the time slots at random;

if the competition duration arrives, checking whether or not a competition message is received from a different mobile sensor node for which the same parent sensor node is set, while sustaining the receiving mode until the selected time slot arrives;

in a state that the competition message is not received from the different mobile sensor node, if the selected time slot arrives, transmitting the competition message and acquiring a priority; and only if the priority is acquired, in the transmitting duration of the uplink or downlink active duration, transmitting a message.

4. The communication method for a mobile sensor node according to claim 3, further comprising:

if the to-be-transmitted message is an urgent or important message, selecting a time slot located at an early portion of the competition duration at the time of selecting the time slot.

5. The communication method for a mobile sensor node according to claim 3, further comprising:

if the priority acquisition fails, increasing the number of failure; and if the number of failure is equal to or larger than a predetermined limit value, reselecting a new time slot located at an early portion of the competition duration.

* * * * *